US007434874B2

(12) United States Patent
Jordan

(10) Patent No.: US 7,434,874 B2
(45) Date of Patent: Oct. 14, 2008

(54) COLLAPSIBLE BENCH AND TABLE COMBINATION

(76) Inventor: Glenn Jordan, 43 High Street, Chipstead, Sevenoaks, Kent TN13 2RW (GB)

( * ) Notice: Subject to any disclaimer, the term of this patent is extended or adjusted under 35 U.S.C. 154(b) by 0 days.

(21) Appl. No.: 11/234,680

(22) Filed: Sep. 23, 2005

(65) Prior Publication Data

US 2006/0170256 A1 Aug. 3, 2006

(51) Int. Cl.
*A47B 3/14* (2006.01)

(52) U.S. Cl. ..... 297/158.4

(58) Field of Classification Search ..... 297/157.1, 297/158.3, 158.4

See application file for complete search history.

(56) References Cited

U.S. PATENT DOCUMENTS 1,585,954 A 5/1926 Widmark
1,594,572 A 8/1926 Soltesz
1,823,484 A 9/1931 Blumenthal
2,257,550 A 9/1941 Gay
2,548,682 A * 4/1951 Price ..... 297/158.4
3,141,424 A * 7/1964 Seymour ..... 108/171
3,256,037 A * 6/1966 Giambalvo ..... 297/158.4
4,700,987 A 10/1987 Sraka et al.
5,052,308 A * 10/1991 Brown ..... 108/118
5,411,314 A * 5/1995 Wallace ..... 297/158.4

* cited by examiner

*Primary Examiner*—Joseph F Edell
(74) *Attorney, Agent, or Firm*—Gauthier & Connors LLP

(57) ABSTRACT

A bench/table combination suitable for picnic tables and the like which is easily collapsible and is strong when erected. The folding action allows the table top, legs and benches to be folded to assume a generally vertical position, the table top being made of two halves and hinged about a central axis, a pair of legs attached to each table top half and being pivotally attached to their respective table top half, and bench supports extending between each pair of legs being pivotally attached to the legs.

6 Claims, 6 Drawing Sheets

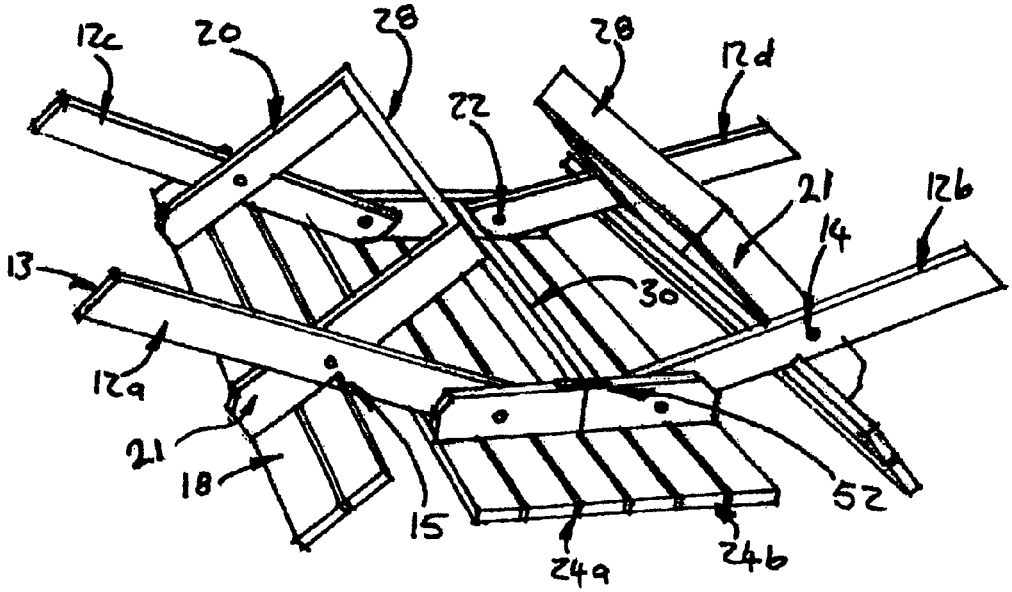
FIG. 3
FIG. 4
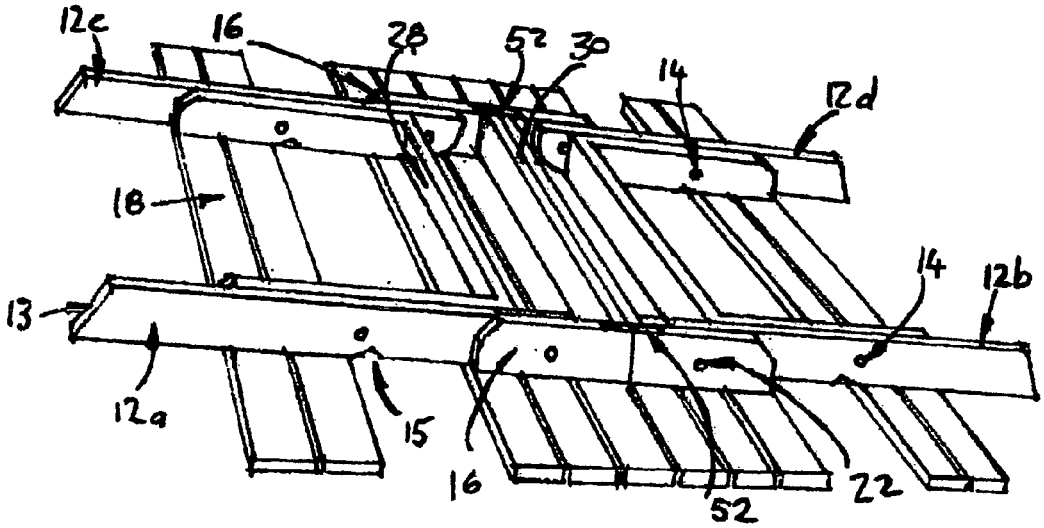

COLLAPSIBLE BENCH AND TABLE COMBINATION

BACKGROUND OF THE INVENTION

1. Field of the Invention

This invention relates to a bench and table combination which is collapsible for easy storage.

2. Description of the Prior Art

Picnic tables with integral benches are well known in the prior art and are often found in places such as country parks and in gardens belonging to public houses. These are typically of solid timber construction and remain outside all year round as they are rather large and pose problems for storage. The wood can deteriorate when left outside. It may become rotten and often looks discoloured and dirty.

There are picnic tables and benches available on the market which are collapsible, but these are often made of a plastic material and are not usually as sturdy as the known wooden picnic bench/table combinations. Also known are modular tables and chairs which can be easily stored, but take a long time to put together.

The prior art includes a variety of collapsible table and bench combinations, which fold along the length of the table top into a more compact arrangement for storage purposes.

U.S. Pat. No. 1,823,484 of Blumenthal describes a table which is supported by legs positioned close to the outer edges of the table top, and which cross one another and are pivotally secured at their midpoint. The assembly is rather complicated, being pivoted at many other points, in particular a connecting strut between the two seats is pivoted at its midpoint, to each of the seats and each of the table legs and additionally incorporates a sliding mechanism.

U.S. Pat. No. 1,594,572 of Soltesz describes a table top which is similarly supported by legs positioned close to the outer edges of the table top, the seats being supported by a brace pivoted at several points along its length and extending between the midpoint of the table top and the inner edge of the seat.

U.S. Pat. No. 2,257,550 of Gay, U.S. Pat. No. 1,585,954 of Widmark and U.S. Pat. No. 4,700,987 of Sraka et al. all describe an arrangement in which the table legs are angled towards the table top, with their ends meeting along the longitudinal axis of the table. The table top is therefore not supported at its outer edges by the table legs, and a variety of vertical supporting struts are necessary as a result. Gay shows the use of vertical table top supports which are detachably fixed to the outer edges of the table top and extend down and are pivoted to the table legs. Sraka et al. describes the use of table top supports which are interconnected to horizontal braces, both being pivotally and slidably connected to the table top and seats. Widmark describes a table top incorporating a storage box which extends along the longitudinal central portion of the table top. The remainder of the table top extending either side of the box is formed of two leaves which are hinged to swing down to a horizontal position for storage within the box. The benches and table legs similarly are hinged to fold to a horizontal position for storage within the box.

All the prior art documents referred to describe collapsible table and bench combinations which are relatively complicated, involving the use of extra supporting struts and braces which may be pivotally or slidably attached to the frame, and as such make the assembly more difficult and time consuming to assemble and collapse.

SUMMARY OF THE INVENTION

It is accordingly an object of the invention to overcome the problem of storage, and to provide a bench/table combination which is easily collapsible and is strong when erected. According to the invention these and other objects are met by a collapsible bench and table combination comprising:

- a table top made up of two parts hingedly connected together so that the table top can fold in half about a central axis;
- a pair of legs attached to each table top half, the legs of each pair being pivotable relative to the respective table top half, about a common axis spaced from and parallel to the axis of pivoting of the two table top halves, between a working position in which the legs can stand on the ground to support the table top and a stowed position in which the legs lie substantially parallel to the respective table top part and,
- a bench support extending between each said pair of legs and pivotally attached to the legs of each pair at positions spaced from the table top to pivot about an axis parallel to the axis of pivoting of the legs, each said bench support comprising an outer portion with a bench extending at least between its respective supporting legs and an inner part extending under the table top when the table is erected, the respective inner parts of said bench supports being connectable together when the table is erected, to hold the table in its erect position.

It is a further object of the invention to provide a bench/table combination which collapses in such a way that in the collapsed state the bench/table combination takes up a lot less space than in the erected state. The combination of the invention is made up of individual pieces of construction material which are held together by any suitable means such as bolts. These pieces can remain held together when the device of the invention is both stored and erected. This permanent joining means that the bench/table assembly may be erected and collapsed quickly and easily without the use of tools and removes the risk of pieces becoming lost during storage as can often happen.

BRIEF DESCRIPTION OF THE DRAWINGS

Further objects and advantages of the present invention will become apparent from the following detailed description when read with reference to the accompanying drawings, which illustrate preferred embodiments thereof.

In the drawings:

FIG. 3 shows a perspective view of the assembly of FIG. 1 in a semi-collapsed state;

FIG. 4 shows a perspective view of the assembly after a second stage of collapsing;

DETAILED DESCRIPTION OF THE PREFERRED EMBODIMENTS

Figure 1:
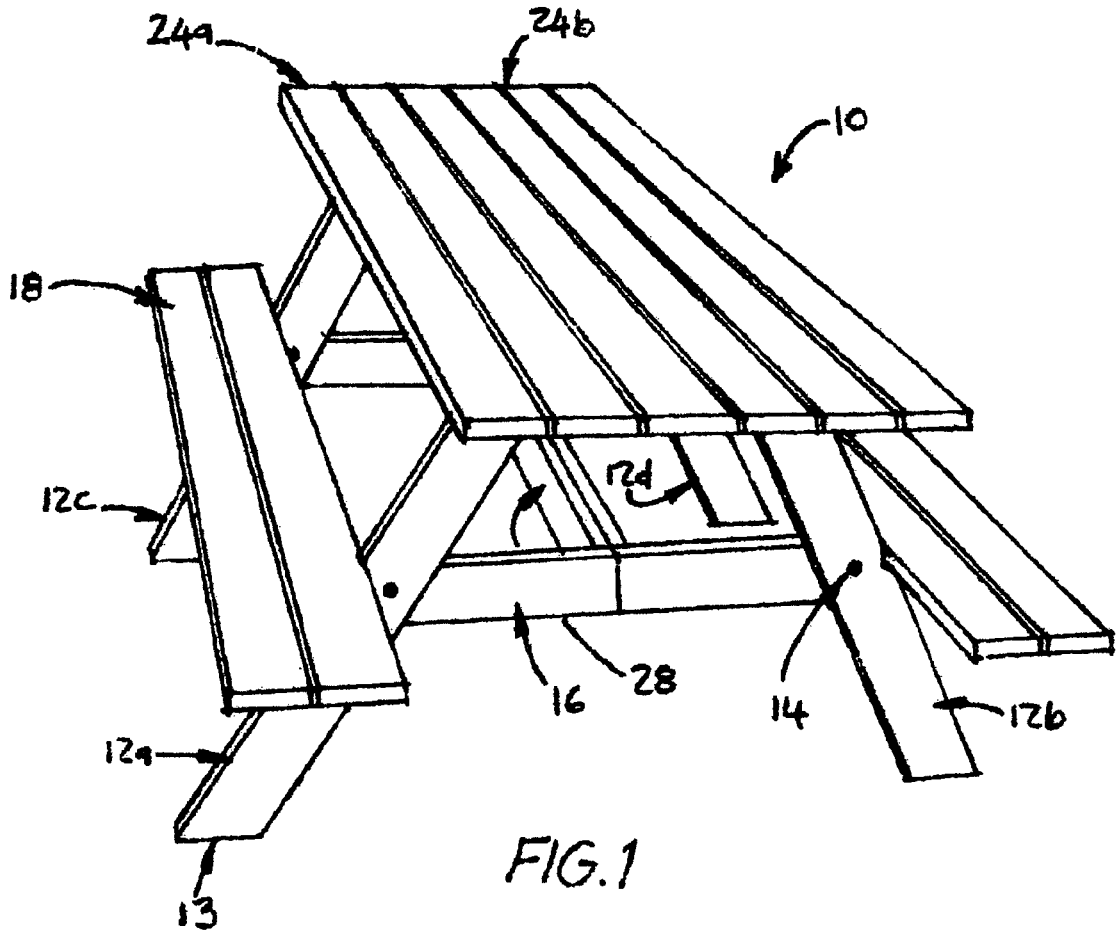
FIG. 1 shows a perspective view of an erected bench/table combination according to a first embodiment of the present invention.
Figure 2:
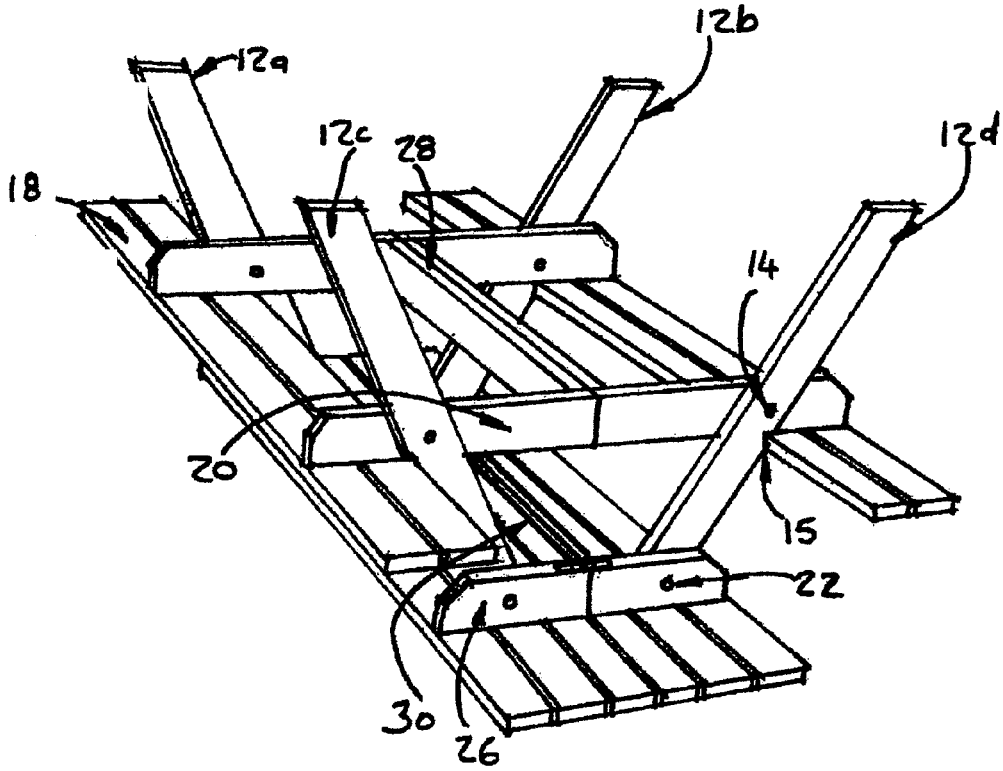
FIG. 2 shows the erected bench/table combination of FIG. 1, inverted prior to collapsing.

Referring to FIGS. 1 and 2, the bench table combination 10 is shown in perspective view and fully erected. The bench/table combination 10 comprises a table top made of six wooden slats which are joined together in blocks of three by transverse portions 26 which are arranged in abutting pairs at right angles to the slats. Each transverse portion 26 is connected to another transverse portion on the same block of slats by a connecting strut 30. The two connecting struts of the bench/table combination are secured to the inside of the innermost slat of each block so that they abut one another longitudinally. The abutting pairs of transverse portions 26 are connected by respective hinges 52 and allow the table top to be folded in half about a longitudinal axis.

Attached to each transverse portion 26 is a leg 12 which is pivotable about an axis 22. The legs are arranged such that the two legs on the same half of the table top run parallel with one another. The legs extend away from the centre of the table at an angle of less than 90 from the table top. The pivoting axes 22 are all parallel to the axes of hinges 52 and those on each half of the table are coaxial and spaced from the longitudinal axis of hinges 52, in a direction towards an outer edge of the table top.

Because the pivots 22 are positioned closer to the outer edges of the table top than to the centre line of the table, forming a quadrilateral or trapezium configuration with the bench supports, a rigid structural support is provided for the table top and benches.

Approximately halfway down each leg 12 is another pivot 14 about which a bench 16 can rotate. Each bench comprises two wooden slats 18 which run parallel with the slats of the table top. Attached to the underside of the slats 18 is a bench support 20 comprising a pair of bench support beams 21 which are at right angles to the direction of the wooden slats. The bench support beams 21 are attached to respective table leg to be rotatable about a respective pivot 14. The bench supports 20 are beneath the transverse portions 26. The two support beams 21 of each bench 16 are joined together by a respective connecting strut 28 to form the complete bench support. When the bench/table combination is erected, as shown in FIGS. 1 and 2, the two connecting struts 28 are in direct abutting contact with one another and bolted together, giving the bench/table combination its strength and stability.

Each bench extends for at least the length of the table top. The table top, benches and lower end of the legs are all parallel with one another when the bench/table combination is erected.

Approximately halfway along each leg is a notch 15. When the bench/table combination is fully erected, the inner slat 16 of each bench engages in one of these notches. This helps to locate the most desirable and firm position for the bench/table combination to be in when erected. These notches also help to increase the stability of the erected structure.

FIG. 3 shows a perspective view of an inverted semi-collapsed bench/table combination according to the first embodiment of the invention after the first stage of it being collapsed. The legs 12 have been pivoted about pivot points 22 and the benches 16 have been pivoted about points 14, the connecting struts 28 having been unbolted from one another.

FIG. 4 shows a perspective view of a partially collapsed bench/table combination according to the first embodiment of the invention. The legs have been rotated by their maximum amount around point 22 so that the outer side of each leg is now flush with the underside of the table. The benches 16 have been rotated to their maximum capabilities about point 14 and are also flush with the underside of the table portions so that the whole assembly lies flat. From this stage, the table top may be folded in half about hinges 52 by bringing together the two pairs of legs at each end of the table.

Figure 5:
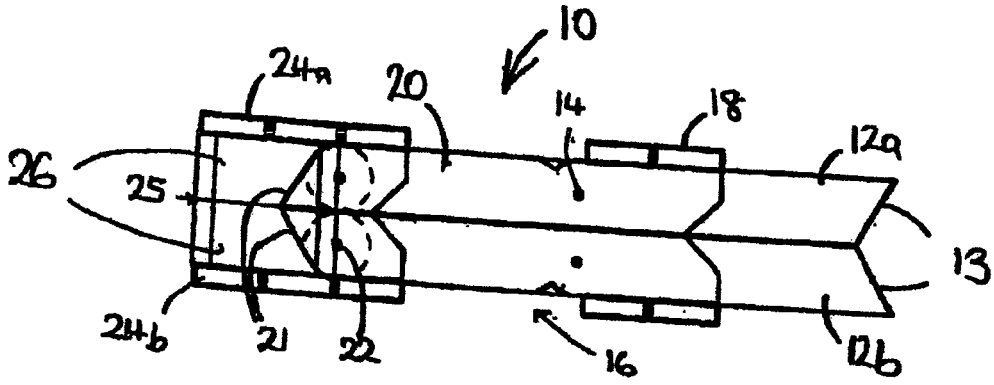
FIG. 5 shows a side on view of the assembly of the invention in a fully collapsed state.

FIG. 5 shows a side on view of the assembly according to either embodiment of the invention in a fully collapsed state. Legs 12*a* and 12*b* are in close proximity to one another, and are shown in the figure to be touching. Legs 12*c* and 12*d* are positioned exactly the same as legs 12*a* and 12*b* but towards the other end of the table portions. The lower end of each leg 13 is angled so as to sit evenly on a surface when fully erected. Towards the centre of each leg is a pivot point 14 about which pivots the bench portions 16 of the assembly.

When the bench/table combination is in its fully collapsed state, as shown in FIG. 5, it can be stored easily. As the legs are together, the construction is robust and will withstand most forces applied on it during its storage.

Figure 6:
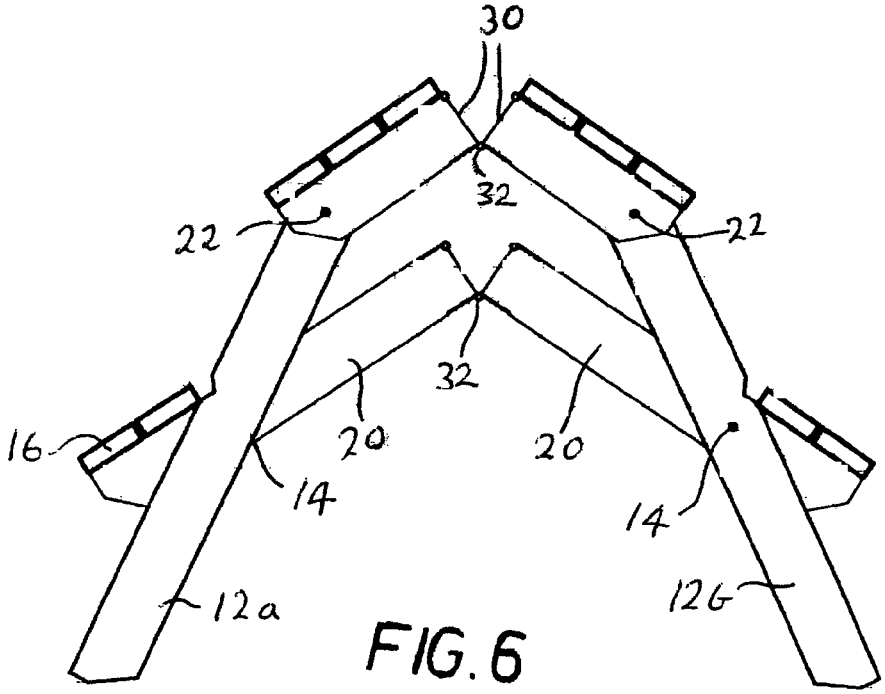
FIG. 6 shows a side on view of a second embodiment of the invention after a first stage of collapsing and FIG. 7 shows a side on view of the erected bench/table combination of FIG. 6, with enlarged details shown as 7A and 7B.

FIG. 6 shows a side on view of a second embodiment of the invention after a first stage of collapsing the bench/table combination. This embodiment differs from that shown in FIGS. 3 and 4 in that the bench supports 20 are hingedly connected together at their lower edges by hinges 32 so that the assembly cannot lie flat as in FIG. 4. The benches and table top halves are parallel to one another and pivot together in a single collapsing movement. The legs 12*a* and 12*b* are moved towards one another, as are legs 12*c* and 12*d*, not shown. The legs pivot about axes 22, as do the table portions. The moving together of the legs also causes the benches to pivot about axes 14. The benches 16 are moved from their locations in the notches 15 by the force applied in bringing the two pairs of legs together. The connecting struts 30 no longer abut one another, instead the upper end of each strut moves away from that of its opposing strut whilst the lower ends remain in contact due to the bench supports 20 being hingedly attached to one another.

Figure 7:
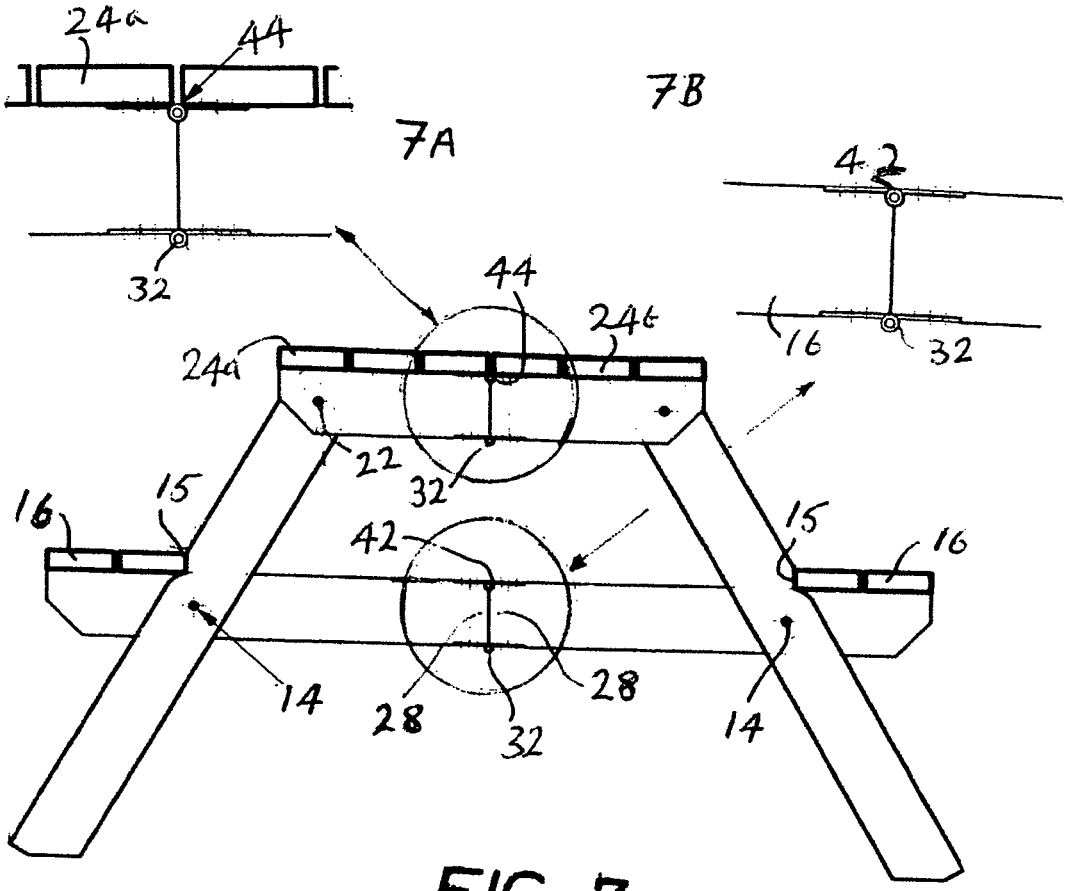
Figure 8:
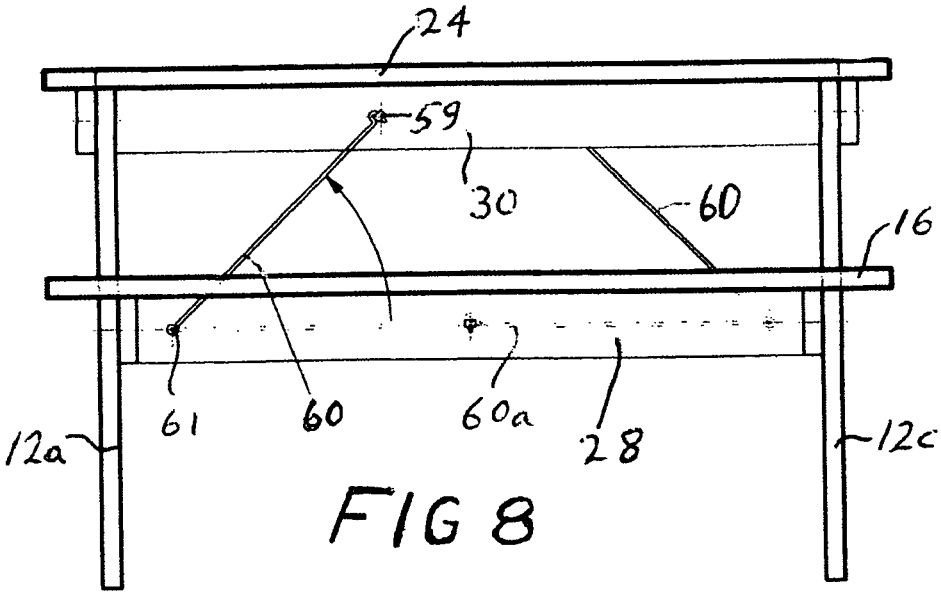
FIG. 8 is a side elevation of the fully erected table.

FIG. 7 shows in side on view the bench/table combination fully set up and ready for use. Benches 16 extending between each pair of legs are parallel with the table portions 24*a* and 24*b*. The connecting strut 28 of the bench 16 now abuts another connecting strut 28 of the opposing bench. The table portions are parallel with the bench portions which in turn are parallel with the lower ends of the legs. This abutting only allows the bench and table portions to pivot a certain amount around the pivot pins. Once the connecting struts are in an abutting configuration, the table and seating portions can pivot no further, thus adding to the rigidity of the structure. Notches 15 are shown to engage with the bench 16. These notches not only provide a means of strengthening the structure, they also provide a means of knowing how far the benches may be rotated about point 14. The notches prevent the benches 16 from being rotated too far about point 14. The top of each leg is flush with the underside of the table.

In the first embodiment of the present invention, the bench/table combination is erected from its storage position firstly by moving the legs 12*a* and 12*c* away from 12*b* and 12*d* through a 90° motion about point 25. The pairs of legs are then brought towards each other by pivoting each leg about an axis 22. Once the lower ends of the legs are firmly on the ground, the bench 16 can then be rotated about pivots 14 until they are parallel with the floor and the table top.

In the second embodiment of the invention, the bench/table combination 10 is set up by firstly moving the lower ends of each pair of legs 12 away from the opposing pair of legs. This motion causes the table portions 24 and bench 16 to pivot about points 22 and 14 respectively. The further the legs are from the opposing pair, the more the table portion and benches will pivot.

In both embodiments, the pivoting stops when: the upper end of each leg is flush with the underside of the table portion; the connecting struts 28 of the two benches abut; the connecting struts 30 on the table portions abut and when the bench is engaged in the notches 15 of each leg.

In the embodiment of FIG. 7 the struts 28 are connected to one another, for example with hinges 32 along their lower edges and releasable bolts 42 along their top edges, to reduce the stress on the abutting faces. Such securing means should be easily operated to be in keeping with the notion of an easy to assemble bench/table combination, without the need of tools. The embodiment of FIGS. 6 and 7 uses hinge-type bolts 42 between the tops of bench supports 20 and similar bolts 44 between abutting transverse portions 26 of the table top.

Figure 9A:
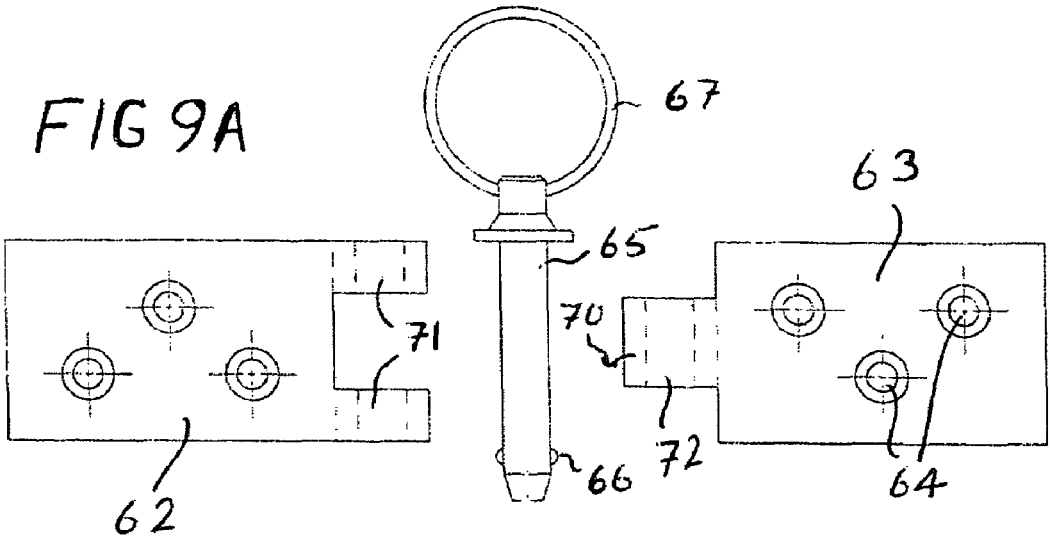
FIGS. 9A to 9C are views of a preferred type of releasable hinge for folding and securing the table of FIGS. 1 to 8.
Figure 9B:
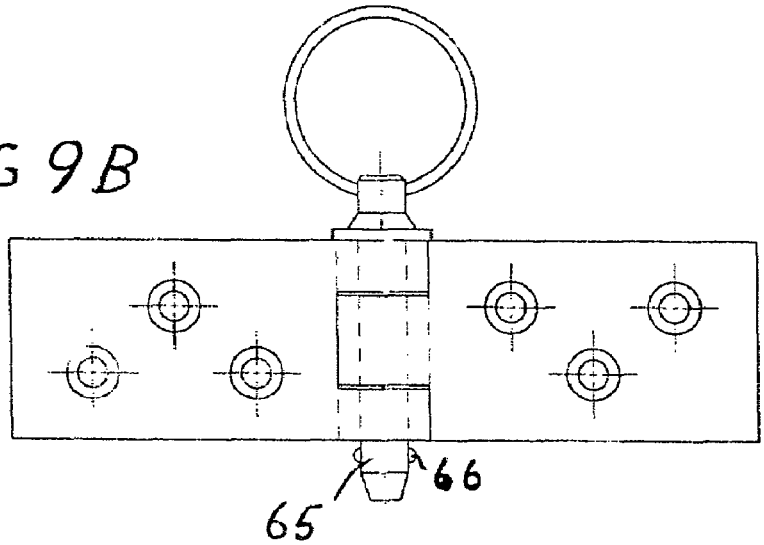
Figure 9C:
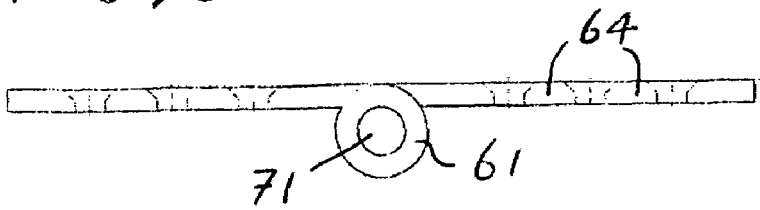

The hinges and bolts holding the structure together are shown enlarged parts 7*a* and 7B of FIG. 7, and in detail in FIGS. 9A-9C. The hinges 32 are, in the embodiment of FIGS. 6 and 7, permanently secured in place so as to hold the two halves of the table together. The hinge-type bolts 42 and 44 are of essentially the same construction, but with removable hinge pins to allow the two halves of each hinge to separate, as in FIG. 6, enabling the table to be folded.

FIG. 9A shows the three components of one of the hinge-type bolts 42, 44, comprising two hinge plates 62 and 63, each secured to one part of the underside of the table, by means of screws through screw holes such as 64. Hinge plate 62 has an integrally formed pair of eyes 71 with aligned bores, with a gap between into which fit a similar eye 70 of hinge plate 63 with a bore 72, so that the bores 71 and 72 are aligned as shown in FIGS. 9B and 9C.

A removable hinge pin 65, fitted with a port wing 67 at one end and having sprung ball-catches 66 at the opposite end, fits through the aligned bores 71, 72, to hold the hinge together, the sprung ball-catches 66 holding the pin in place.

The hinges 32 may be of similar construction to 42 and 44, but may have permanently installed hinge pins rather than removable ones.

When the table of FIGS. 6 and 7 is erected from the folded state shown in FIG. 5, the table top and seat assemblies assume the flat horizontal configuration shown in FIG. 7, in which the bores 71, 72 of each respective hinge 44 engage and align. A pin 65 can then be inserted through each hinge 42, 44 to retain the table in its fully erect position. It will be appreciated that the table is also held in this position by gravity.

To impart additional rigidity, diagonal cross-bracing elements such as cabin hooks 60 can be provided to extend between connecting struts 28 of the seat assembly and connecting struts 30 on the underside of the table top. For example, one cabin hook 60 may be pivotally mounted at 61 on a transverse member 28, to engage a pin or the like 59 projecting laterally from the corresponding transverse member 30.

The bench/table combination may be constructed of any suitable strong material, such as wood. The pivoting means 14 and 22, on each leg may be made from any suitably strong material, such as steel or strong nylon. This pivoting means may comprise a bolt, such as a coach bolt and a locking nut, such as those made by Nylox™.

The bench/table combination can be set up and collapsed by keeping it upright at all times as is shown in FIGS. 1, 6 and 7 or it can be done inverted as is shown in FIGS. 2, 3 and 4.

In order for the bench/table construction to remain in a state for use and storage, it can be surface treated with a variety of products to extend its life.

Instead of rigid struts 28 extending between the bench support beams 21, pivoting diagonal struts could be arranged to extend between the abutting ends of each pair of bench supports and intermediate positions along the lengths of the connecting struts 30. For example, each connecting strut 30 could have one end of one such diagonal strut permanently pivotally attached to it at approximately its mid-point, the diagonal strut being pivotable between a stowed position parallel to the respective connecting strut 30 and a working position in which its free end is secured to a respective bench support.

What is claimed is:

1. A collapsible bench and table combination comprising:

a table top made up of two halves hingedly connected together along a center line so that the table top can fold in half about a central axis between an erect position in which said table top halves are coplanar and a stowed position in which respective undersides of said table top halves face one another, wherein each said table top half comprises a pair of transverse portions on its underside, each transverse portion having first and second ends, a top surface abutting said underside, and a bottom surface opposite said underside, and wherein said first end of each said transverse portion of one table top half is connected to the first end of one of said transverse portions of the other table top half by a hinge secured to the bottom surfaces of said pair of transverse portions, whereby in said erect position said pair of transverse portions abut one another end to end;

a pair of legs attached to the second ends of the respective transverse portions of each table top half, the legs of each pair being pivotable relative to the respective table top half, about a common axis between a working position in which the legs can stand on the ground to support the table top and a stowed position in which the legs lie substantially parallel to the respective table top half, said common axis of each said pair of legs being spaced from and parallel to the hinged connection of the two table top halves and positioned closer to respective outer edges of the table top than to said center line, and a bench support extending between, and pivotally attached to the legs of each pair at positions spaced from the table top to pivot about an axis parallel to the axis of pivoting of the legs, each said bench support having upper and lower surfaces and comprising an outer portion with a bench mounted on said upper surface and extending at least between the respective supporting legs and an inner part extending under the table top when the table is erected, the respective inner parts of said bench supports being securable together in an abutting relationship when the combination is erected, to hold the combination in the erect position, wherein the respective inner parts of the bench supports are connected together by hinges on said lower surface whereby the bench supports can pivot relative to one another, about an axis parallel to the axis of pivoting of the bench supports relative to the legs, between a position in which, in the erect position of the combination, said benches are coplanar and parallel to the table top, and a stowed position in which said benches are pivoted downwards towards a position parallel to the legs on which the respective bench supports are mounted, whereby said combination can be folded from said erect position into the stowed position in a single operation wherein the table top is folded in half, drawing respective pairs of legs together, thereby causing said bench supports to pivot into their respective stowed positions.

2. A bench and table combination according to claim 1 wherein each said bench support comprises a pair of bench support beams, each said support beam having an inner end and an outer end, and being pivotally attached to a respective leg of the pair of legs at a position intermediate between said inner and outer ends, the outer end of said beam supporting a bench seat and the inner end being hingedly connected to an inner end of a corresponding said support beam of the other bench support.

3. A bench and table combination according to claim 2 wherein each pair of support beams are connected together by a connecting strut, the respective connecting struts of said two bench supports abutting one another when the table is erected.

4. A bench and table combination according to claim 1 wherein each leg of the pair of legs has a notch in an outer edge thereof positioned to receive an edge of a respective bench to assist in locating said bench when the table is erected.

5. A bench and table combination according to claim 1 wherein each said table top half comprises a plurality of slats, the slats of each table top half being connected together by being secured to said top surfaces of said transverse portions.

6. A bench and table combination according to claim 5, wherein the respective transverse portions of said two table top halves are arranged in abutting pairs at right angles to the slats.

* * * * *